US010211573B2

(12) United States Patent
Zhao

(10) Patent No.: US 10,211,573 B2
(45) Date of Patent: Feb. 19, 2019

(54) ELECTRICAL CONNECTOR HAVING FORWARDLY EXTENDING STOPPER ON METALLIC OUTER SHELL

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/813,060

(22) Filed: Nov. 14, 2017

(65) Prior Publication Data

US 2018/0138638 A1 May 17, 2018

(30) Foreign Application Priority Data

Nov. 14, 2016 (CN) ..... 2016 1 1005305

(51) Int. Cl.

| | |
|---|---|
| ***H01R 13/6581*** | (2011.01) |
| ***H01R 13/405*** | (2006.01) |
| ***H01R 43/20*** | (2006.01) |
| *H01R 12/71* | (2011.01) |
| *H01R 13/6585* | (2011.01) |
| *H01R 24/60* | (2011.01) |
| *H01R 12/72* | (2011.01) |

(52) U.S. Cl.

CPC ..... *H01R 13/6581* (2013.01); *H01R 13/405* (2013.01); *H01R 43/20* (2013.01); *H01R 12/716* (2013.01); *H01R 12/724* (2013.01); *H01R 13/6585* (2013.01); *H01R 24/60* (2013.01)

(58) Field of Classification Search

CPC .. H01R 13/6581; H01R 13/405; H01R 43/20; H01R 12/716; H01R 13/6585; H01R 24/60; H01R 13/6593

USPC ..... 439/607.27, 607.55

See application file for complete search history.

(56) References Cited

U.S. PATENT DOCUMENTS

| | | | | |
|---|---|---|---|---|
| 7,837,506 | B1 * | 11/2010 | Chiang | H01R 12/707 439/607.27 |
| 9,685,728 | B2 * | 6/2017 | Yao | H01R 13/521 |
| 9,755,348 | B2 * | 9/2017 | Guo | H01R 12/7064 |
| 9,768,560 | B2 * | 9/2017 | Yao | H01R 13/6594 |
| 9,912,106 | B2 * | 3/2018 | Yao | H01R 13/6594 |

(Continued)

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

An electrical connector includes a contact module enclosed within a metallic inner shell, and a metallic outer shell attached upon the inner shell. The contact module includes an insulator and a plurality of terminals integrally formed with the insulator. The insulator includes a base and a tongue portion extending forwardly from the base. The inner shell forms a mating cavity in which the tongue portion extends. The outer shell forms a main body covering the inner shell and a rear cover extending rearwardly from the main body to cover the rear side of the base. The rear cover further includes at least an abutment section forwardly extending toward the base and abutting against a rear face of the base so as to prevent further rearward movement of the contact module relative to the inner shell.

15 Claims, 17 Drawing Sheets

(56) References Cited

U.S. PATENT DOCUMENTS

| | | | | |
|---|---|---|---|---|
| 2014/0187105 | A1* | 7/2014 | Zhao | H01R 12/707 439/733.1 |
| 2016/0233594 | A1 | 8/2016 | Zhao | |
| 2016/0294105 | A1 | 10/2016 | Zhao | |
| 2016/0329667 | A1* | 11/2016 | Tsai | H01R 24/70 |
| 2017/0077654 | A1 | 3/2017 | Yao | |
| 2017/0133795 | A1* | 5/2017 | Guo | H01R 13/405 |
| 2017/0302031 | A1 | 10/2017 | Cheng | |

* cited by examiner

FIG, 9

ELECTRICAL CONNECTOR HAVING FORWARDLY EXTENDING STOPPER ON METALLIC OUTER SHELL

BACKGROUND OF THE DISCLOSURE

1. Field of the Disclosure

The invention is related to an electrical connector and the method of making the same, and particularly to the electrical connector having the contact module secured within the shell.

2. Description of Related Arts

US Patent Application Publication No. 20170133795 discloses the electrical connector having an inner metallic shell enclosing a contact module, and an outer metallic shell secured to the inner shell wherein both the inner shell and the outer shell have the securing structures for retaining to the housing of the contact module. Anyhow, during mating, the relatively large insertion force is applied upon the receptacle connector, thus tending to push rearwardly the contact module away from the inner shell.

It is desired to provide an electrical connector with relatively strong retention between the shell and the contact module for resisting the insertion force during mating.

SUMMARY OF THE DISCLOSURE

To achieve the above desire, an electrical connector includes a contact module enclosed within a metallic inner shell, and a metallic outer shell attached upon the inner shell. The contact module includes an insulator and a plurality of terminals integrally formed with the insulator. The insulator includes a base and a tongue portion extending forwardly from the base. The inner shell forms a mating cavity in which the tongue portion extends. The outer shell forms a main body covering the inner shell and a rear cover extending rearwardly from the main body to cover the rear side of the base. The rear cover further includes at least an abutment section forwardly extending toward the base and abutting against a rear face of the base so as to prevent further rearward movement of the contact module relative to the inner shell.

The rear face of the base includes the upper rear face, a lower rear face and a step face therebetween. The rear cover includes a connection section extending downwardly from the main body, and a step section extending rearwardly from the connecting section. The connecting section intimately covers the upper rear face, and the step section intimately cover the step face. The abutment section extends forwardly from the step section. The inner shell further includes at least one rear abutment section extending from rear edge to abut against the upper rear face in a planar manner.

The abutment section is either paired by two sides of the center region if the connection section is located at the center region, or located at the center region if the connection sections are paired by two sides.

The base includes a pair of securing grooves and the main body of the outer shell includes a pair of securing legs received within the corresponding securing grooves, respectively.

DETAILED DESCRIPTION OF THE PREFERRED EMBODIMENT

Figure 1:
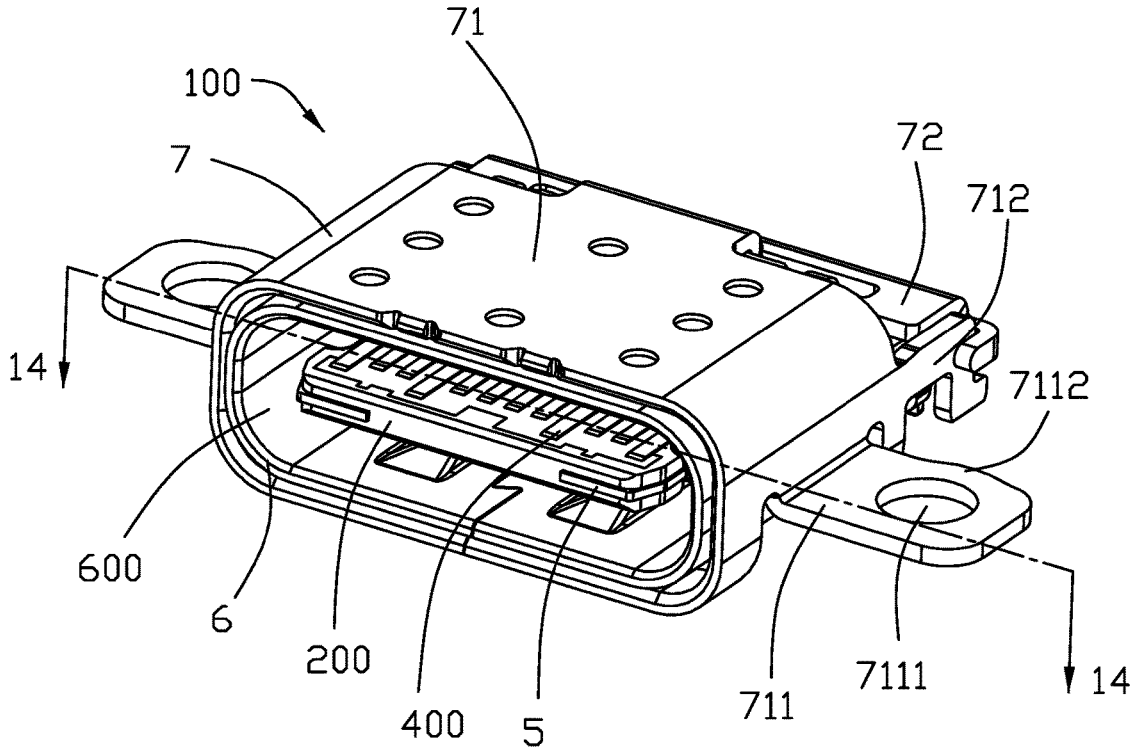
FIG. 1 is a front downward perspective view of an electrical connector according to the invention.
Figure 2:
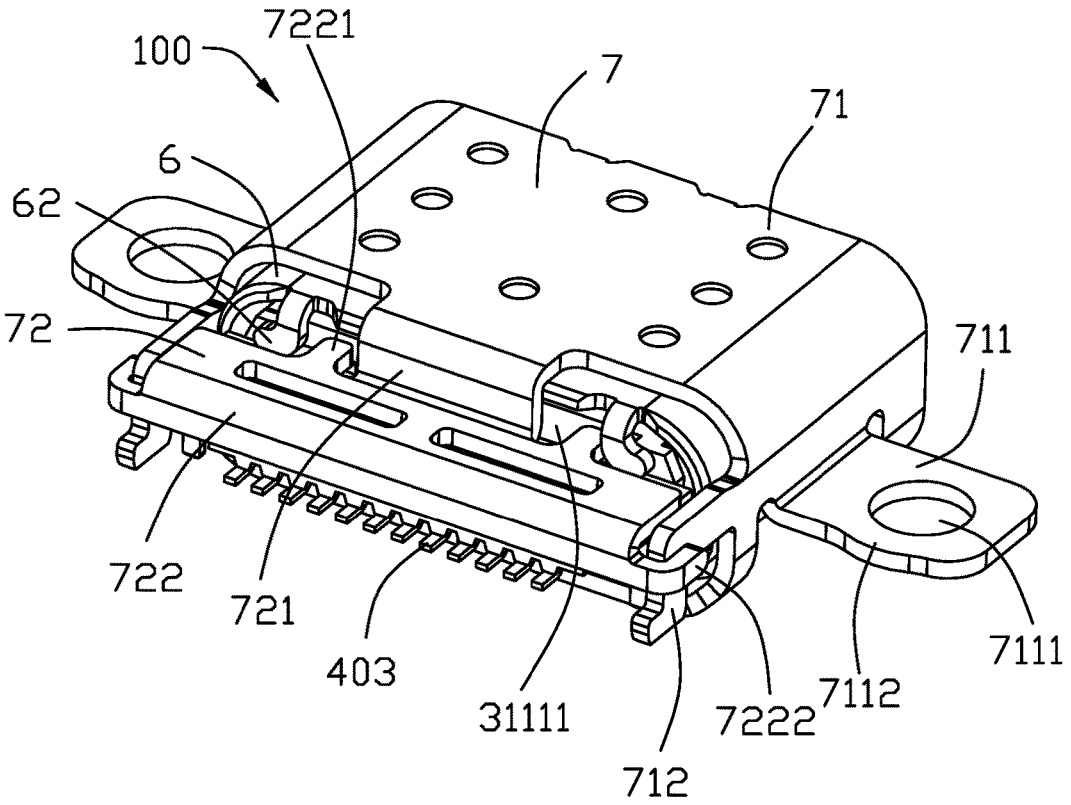
FIG. 2 is a rear downward perspective view of the electrical connector of FIG. 1.
Figure 3:
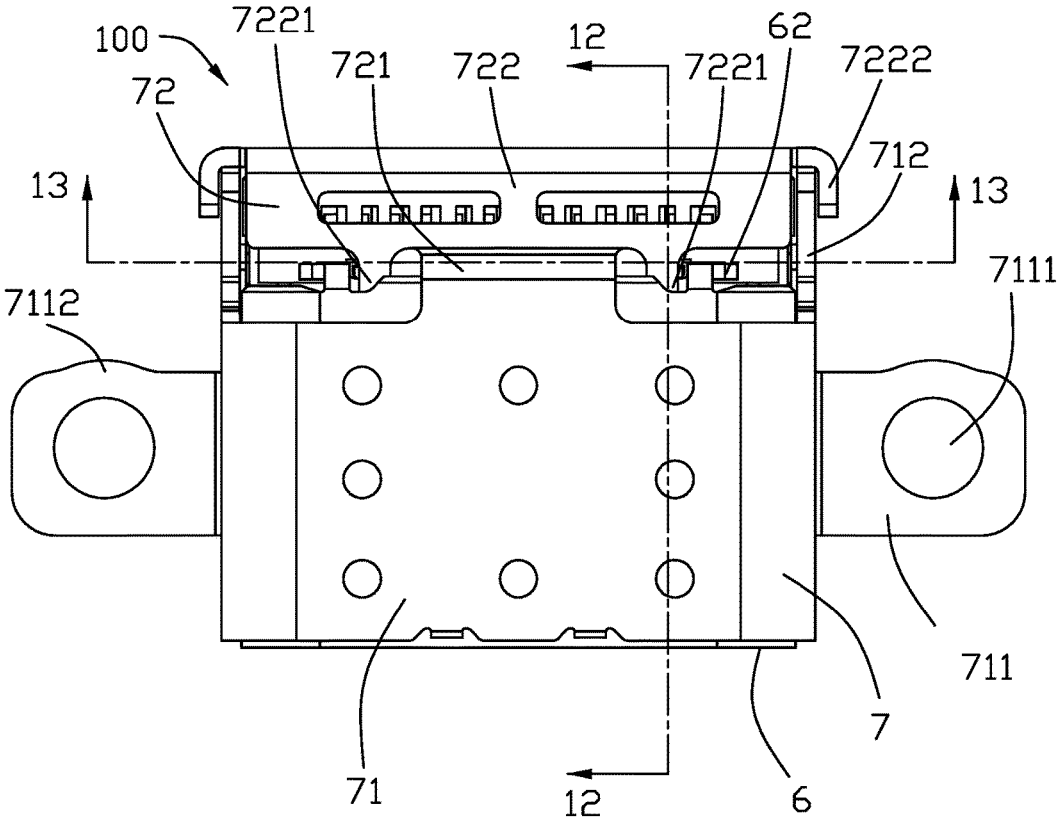
FIG. 3 is a top view of the electrical connector of FIG. 1.
Figure 4:
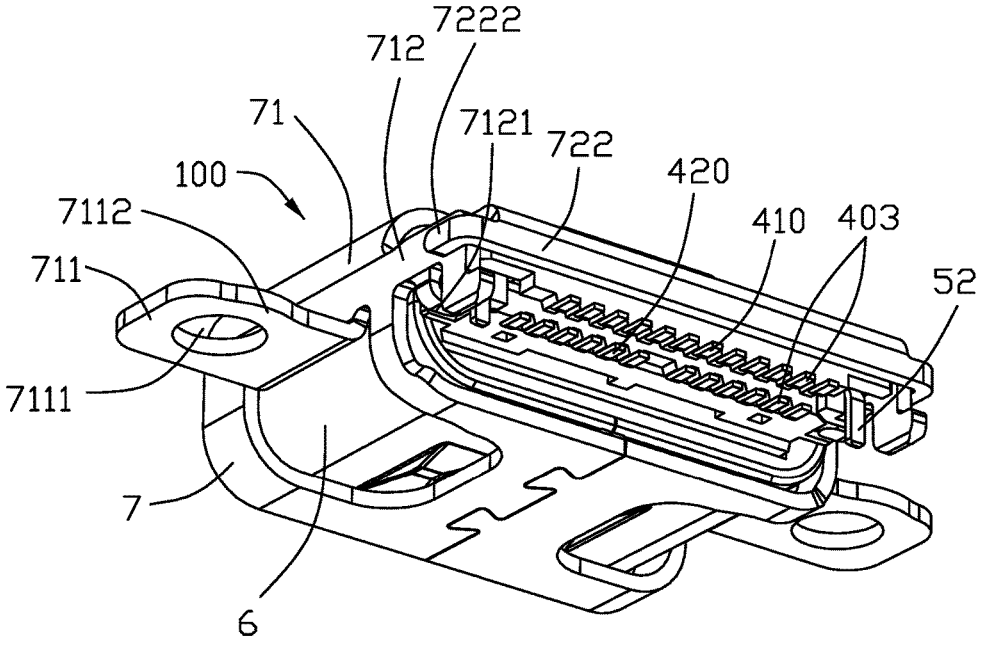
FIG. 4 is a rear upward perspective view of the electrical connector of FIG. 1.
Figure 5:
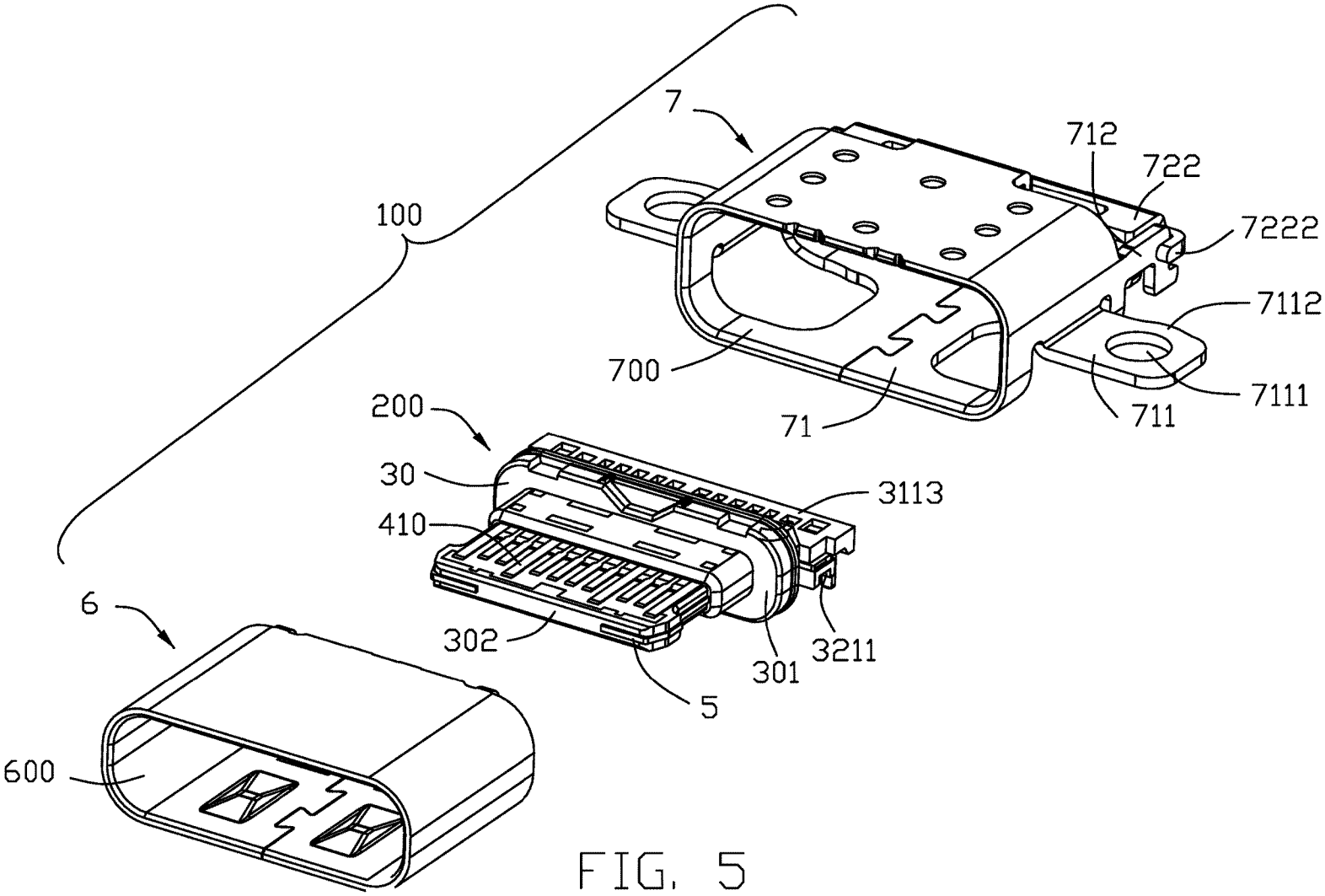
FIG. 5 is a front downward exploded perspective view of the electrical connector of FIG. 1.
Figure 6:
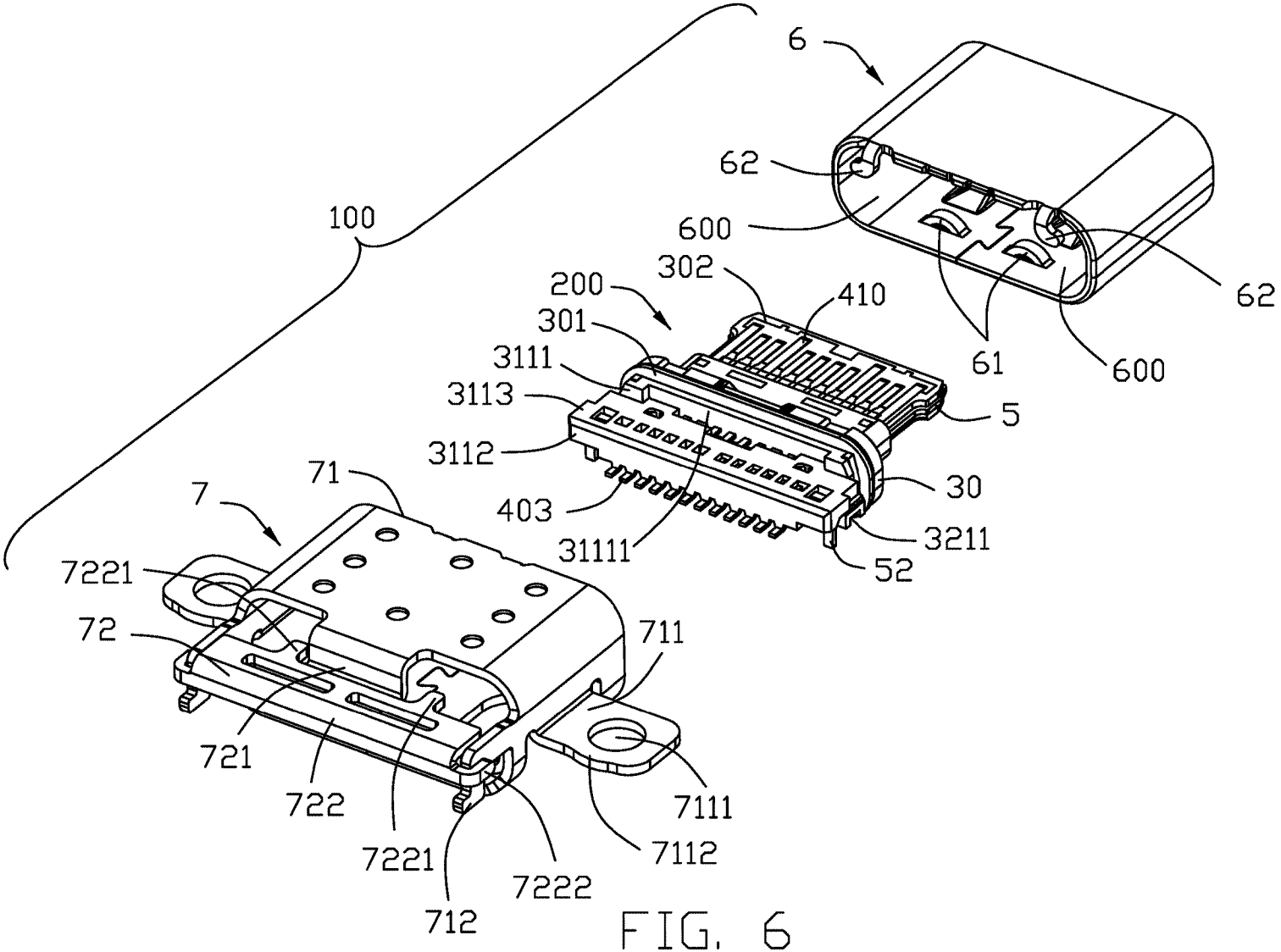
FIG. 6 is a rear downward exploded perspective view of the electrical connector of FIG. 2.
Figure 7:
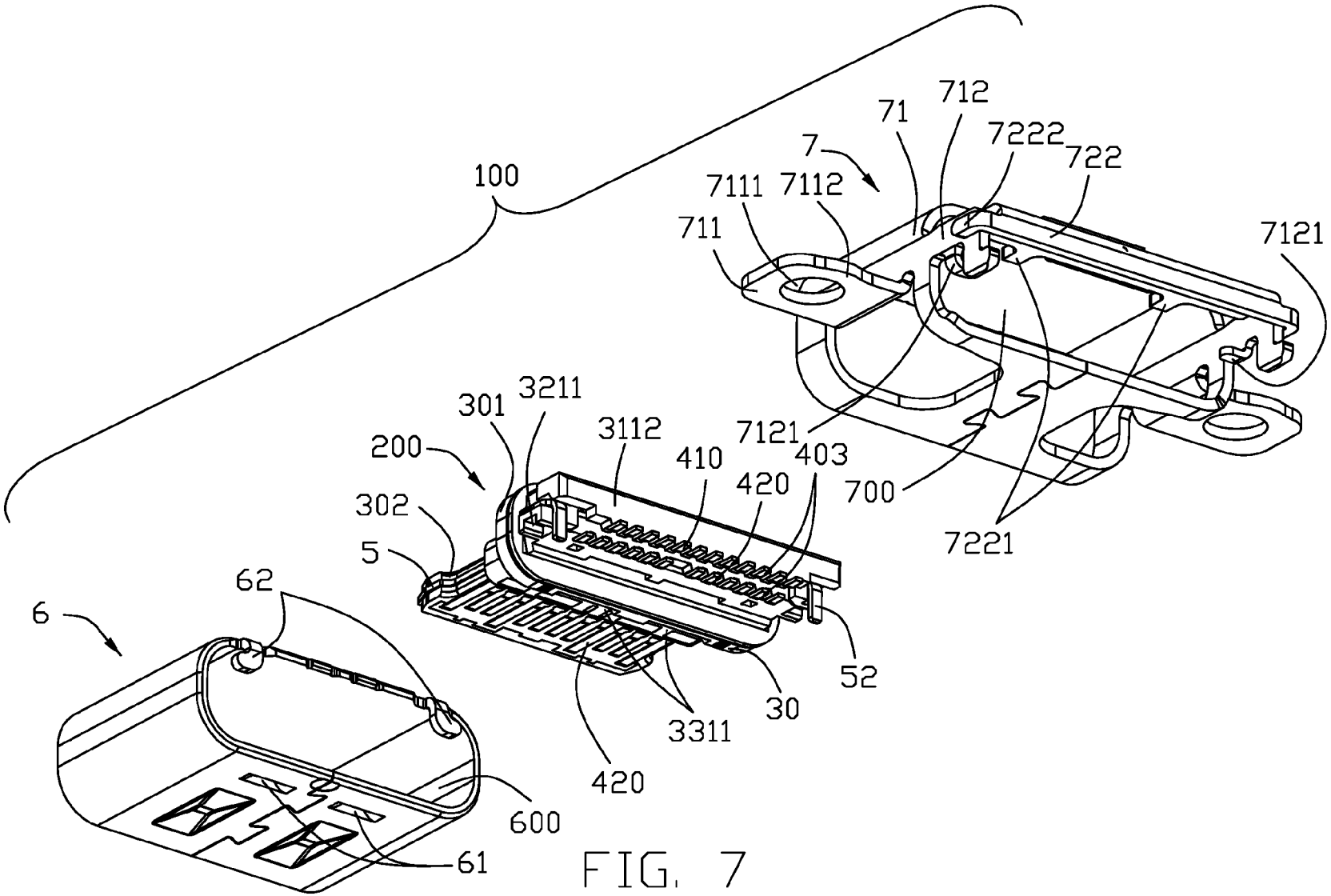
FIG. 7 is a rear upward exploded perspective view of the electrical connector of FIG. 4.
Figure 8:
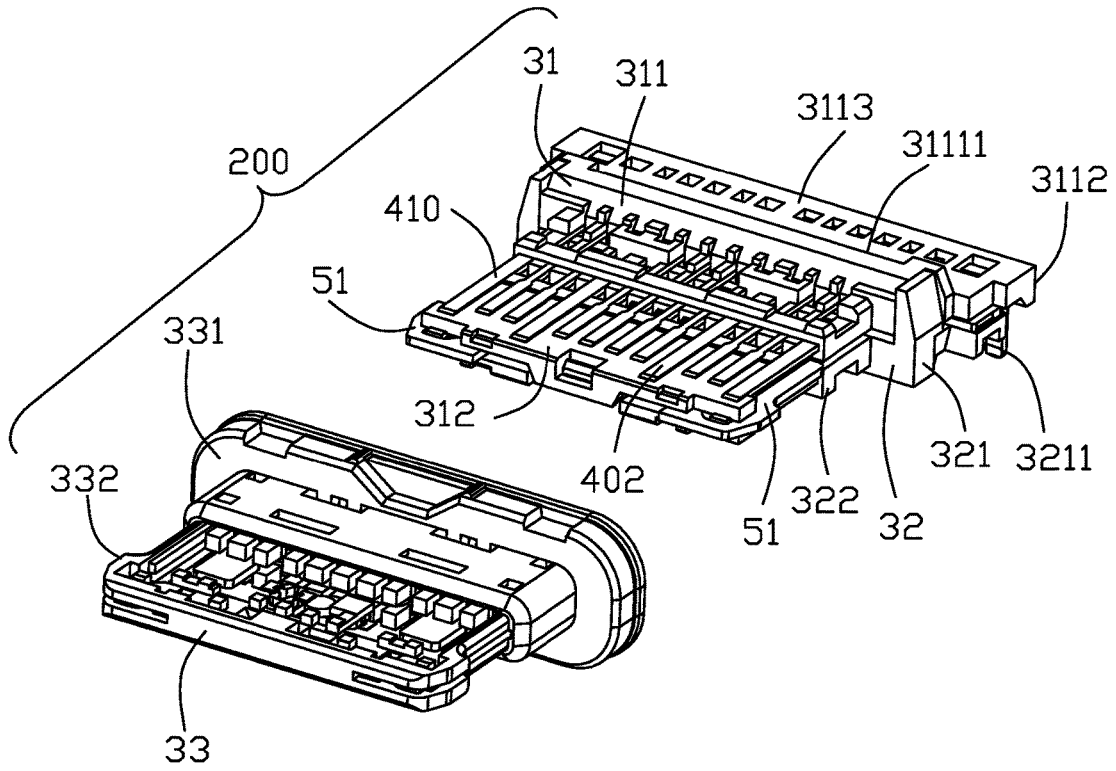
FIG. 8 is a further front downward explode perspective view of the contact module of the electrical connector of IFG. 5.
Figure 9:
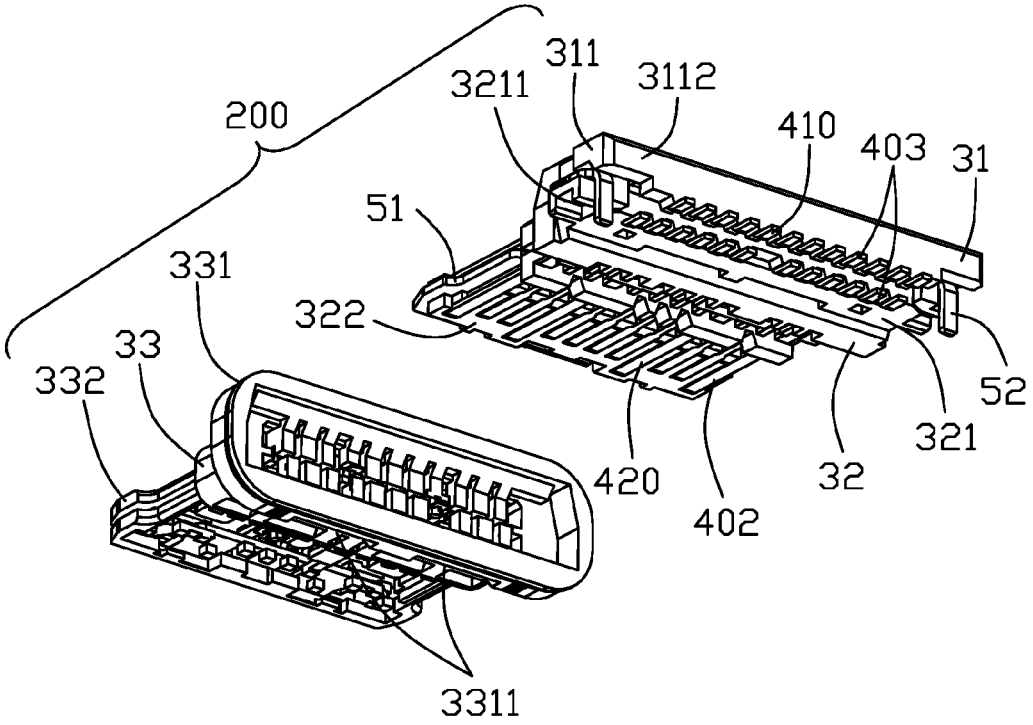
FIG. 9 is a further rear upward exploded perspective view of the contact module of the electrical connector of FIG. 7.
Figure 10:
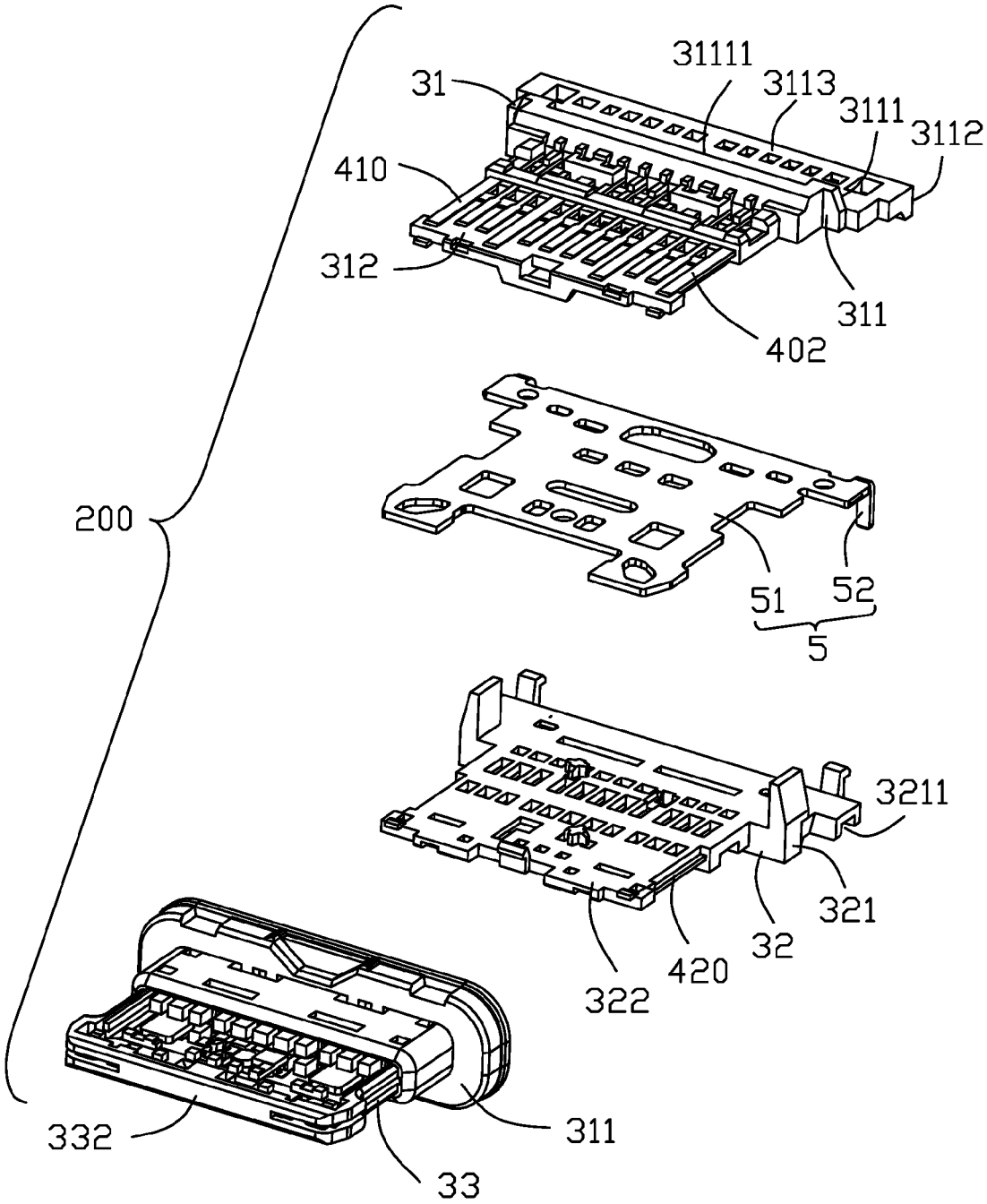
FIG. 10 is a further front downward exploded perspective view of the contact module of the electrical connector of FIG. 8.
Figure 11:
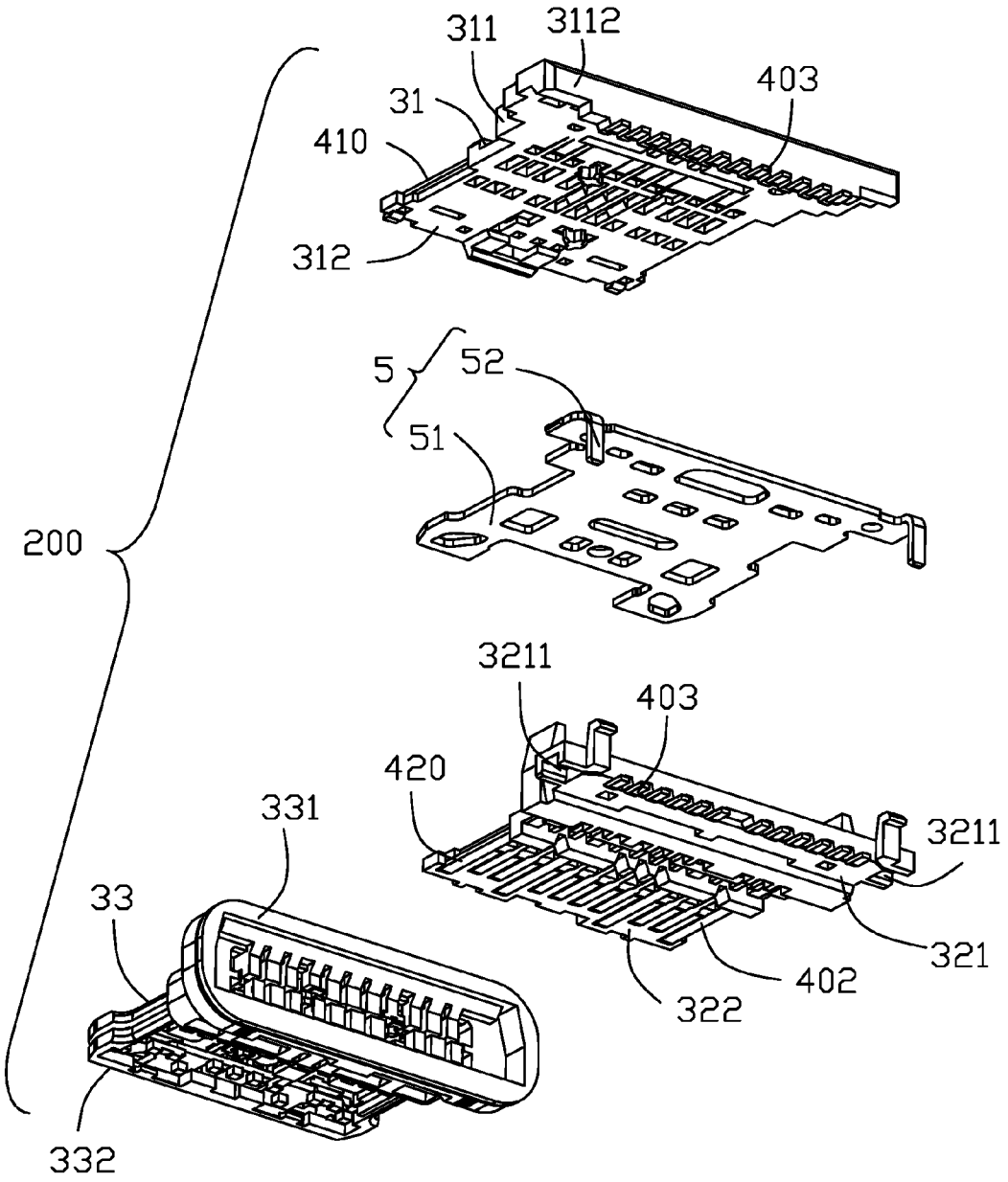
FIG. 11 is a further rear upward exploded perspective view of the contact module of the electrical connector of FIG. 9.
Figure 12:
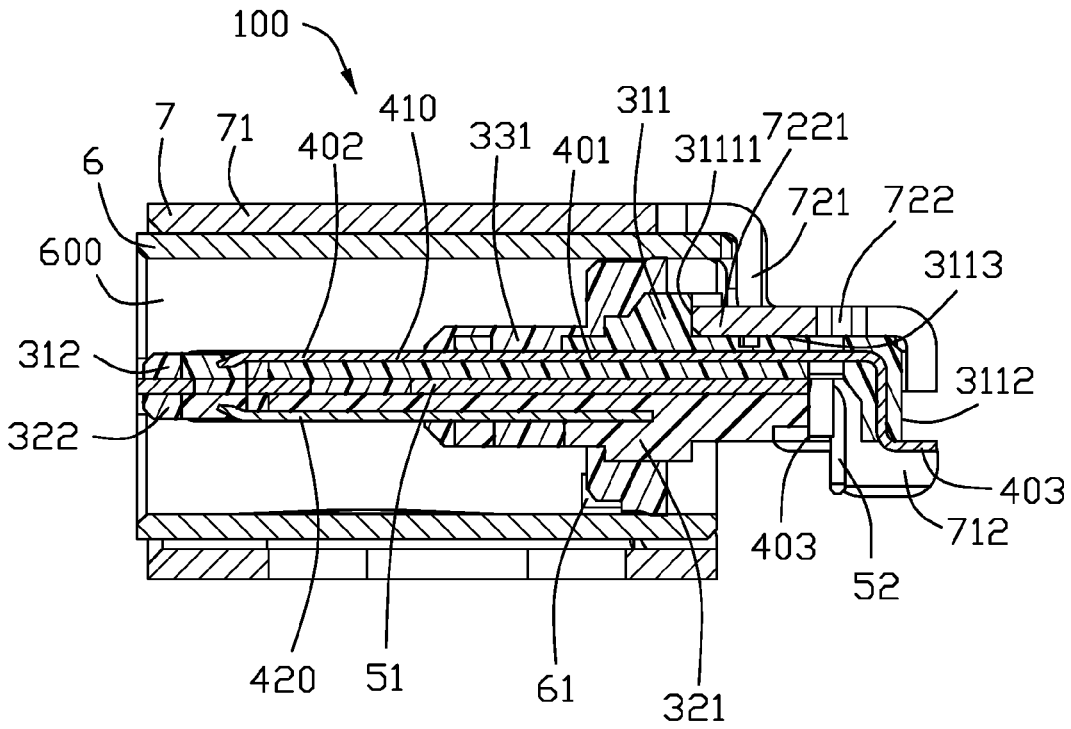
FIG. 12 is a cross-sectional view of the electrical connector of FIG. 1.
Figure 13:
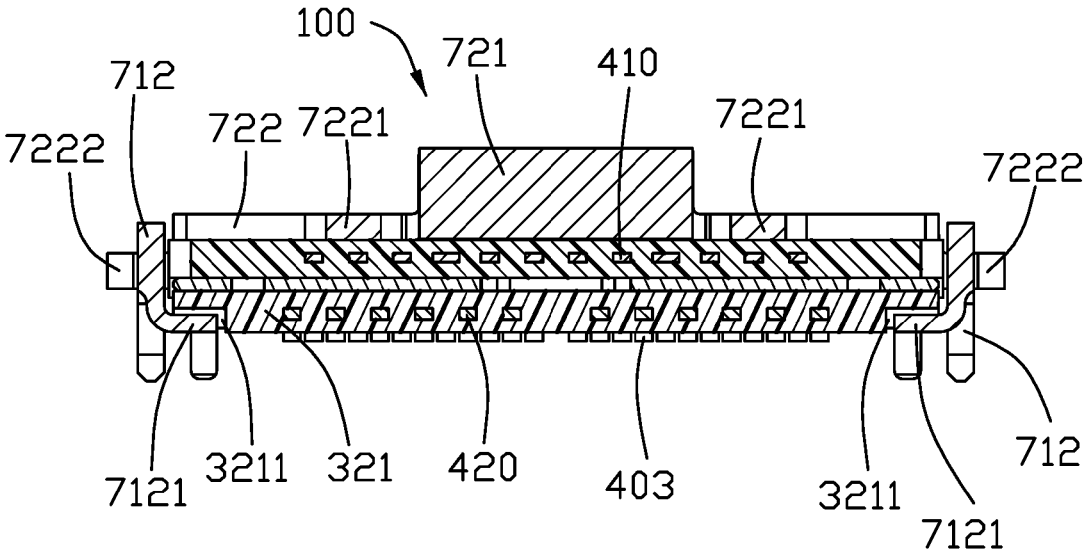
FIG. 13 is another cross-sectional view of the electrical connector of FIG. 1.
Figure 14:
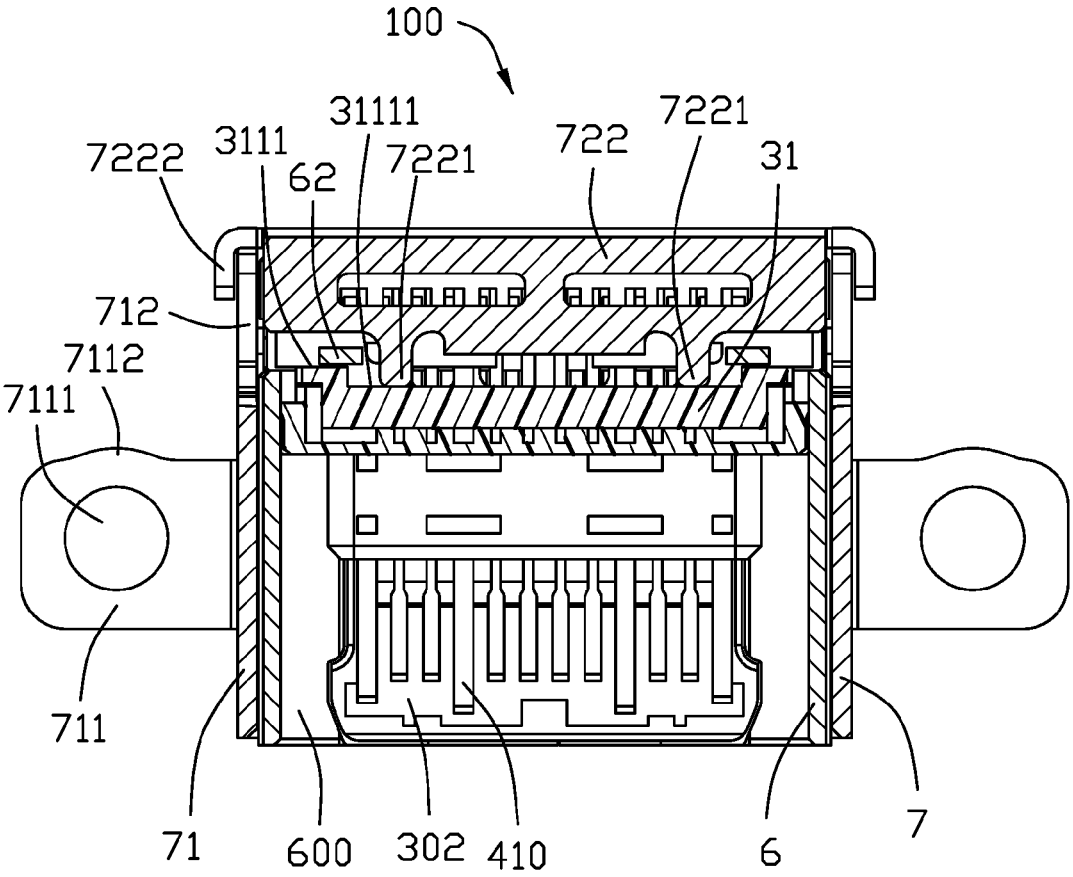
FIG. 14 is another cross-sectional view of the electrical connector of FIG. 1.

Reference will now be made in detail to the embodiments of the present disclosure. Referring to FIGS. 1-17, an electrical card connector 100 form a mating end for receiving a complementary Type C plug connector (not shown) therein along a front-to-back direction.

Referring to FIGS. 1-14, the electrical connector 100 includes a contact module 200, a metallic inner shell 6 enclosing the contact module 200, and a metallic outer shell 7 attached upon the inner shell 6 to form a shell body. The contact module 200 includes an insulative housing 30, a plurality of contacts 400 and a metallic shielding plate 5 commonly retained within the housing 30.

Referring to FIGS. 1-14, the insulative housing 30 includes a base 301 and a tongue portion 302 extending forwardly from the base 301. A root portion of the tongue portion 302 forms a thickened section (not labeled). The insulative housing 30 further includes an upper seat 31, a lower seat 32 and an insulator 33. The upper seat 31 includes a first base 311 and a first tongue portion 312 extending forwardly from the first base 311. The lower seat 32 includes a second base 321 and a second tongue portion 322 extending forwardly from the second base 321. The second base 321 forms a securing groove 3211. The insulator 33 includes a third base 331 and the third tongue portion 332 extending forwardly from the third base 331. The third base 331 forms two positioning grooves 3311. The first base 311, the second base 321 and the third base 331 commonly form the base 301. The first tongue portion 312, the second tongue portion 322 and the third tongue portion 332 commonly form the tongue portion 302. The base 301 father includes the upper/first rear face 3111 and lower/second rear face 3112 and the step face 3113 connected therebetween. In this embodiment, the step face 3113 is horizontal. The first rear face 3111, the second rear face 3112 and the step face 3113 are commonly located behind the first base 311. The first rear face 3111 further includes an abutment groove 31111. The second rear face 3112 is located behind the first rear face 3111 along the front-to-back direction.

The contact 400 includes the securing section 401, the contacting section 402 extending forwardly therefrom, and the soldering section 403 extending rearwardly therefrom. The contacts 400 further include the upper contacts 410 and the lower contacts 420 arranged reversely symmetrical with each other for allowing dual orientation mating.

The metallic shielding plate 5 includes a main plate 51 and the soldering legs 52 extending rearwardly from the main plate 51. The main plate 51 forms the locking edges (not labeled)

The inner shell 6 encloses the tongue portion 302 of the insulative housing 30 to form a mating cavity 600. The inner shell 6 further includes front abutment sections 61 and rear abutment sections 62. The front abutment sections 61 are formed on an inner surface of the inner shell 6 corresponding to the positioning groove 3311. The rear abutment sections 62 extend from a rear edge of the inner shell 6.

The outer shell 7 forms a receiving space 700. The outer shell 7 includes a main body 71 and a rear cover 72 extending from the main body 71. The main body further includes front mounting legs 711 and the rear mounting legs 712. The front mounting leg 711 includes a mounting hole 7111 and a protrusion 7112. The protrusion 7112 is located around a periphery and extending in the front-to-back direction for enhancing the mounting leg 711. The rear mounting leg 712 further includes a securing leg 7121 to be received within the securing groove 3211. The thickness of the securing leg 7121 is smaller than the mounting leg 712 and the depth of the securing groove 3211. The front mounting legs 711 and the rear mounting legs 712 are used for mounting to the printed circuit board (not shown). The rear cover 72 further includes a pair of abutment sections 7221 and a pair of side abutments 7222. The rear cover 72 further includes the connection section 721 extending downwardly from the main body 71, and the step section 722 extending rearwardly from the connecting section 721. The connection section 721 covers the first rear face 3111 and the step section 722 covers the step face 3113. The step section 722 extends horizontally and the pair of abutment sections 7221 extend from the step section 722 and respectively located by two sides of the connection section 721 in the transverse direction. The side abutments 7222 are located at two opposite sides of the step section 722 and bent forwardly for restraining the mounting leg 712.

The method of making the electrical connector 100 includes the following steps:

The upper contacts 410 are integrally formed within the upper seat 31 via an insert-molding process. The lower contacts 420 are integrally formed within the lower seat 32 via another insert-molding process. The upper seat 31 and the lower seat 32 firstly commonly sandwich the shielding plate 5 therebetween, and successively the insulator 33 are applied thereon to form the contact module 200. The inner shell 6 encloses the contact module 200 wherein the front abutment sections 61 are received within the corresponding positioning grooves 3311 for preventing the forward movement of the contact module 200 with regard to the inner shell 6. The rear abutment sections 62 abut against the first rear face 3111 for preventing the rearward movement of the contact module 200 with regard to the inner shell 6. The outer shell 7 is attached upon the inner shell 6 wherein the securing legs are received within the corresponding securing grooves 3211, and the side abutments 7222 restrict outward movement of the rear mounting legs 712. The rear cover 72 covers the first rear face 3111, the step face 3113 and the second rear face 3112 wherein the connection section 721 covers the first rear face 3111, the step section 722 covers the step face 3113, the pair of abutment sections 7221 abut against the abutment groove 31111 for preventing rearwardly movement of the contact module 200 with regard to the inner shell 6 and the outer shell 7. The securing legs 7121 are received within the corresponding securing grooves 3211 for preventing downward movement of the contact module 200 with regard to the inner shell 6 and to the outer shell 7. Via cooperation of the abutment sections 7221 and the securing legs 7121 and the step section 722, the contact module 200 is stably dispose in the inner shell 6 and the outer shell 7.

Figure 15:
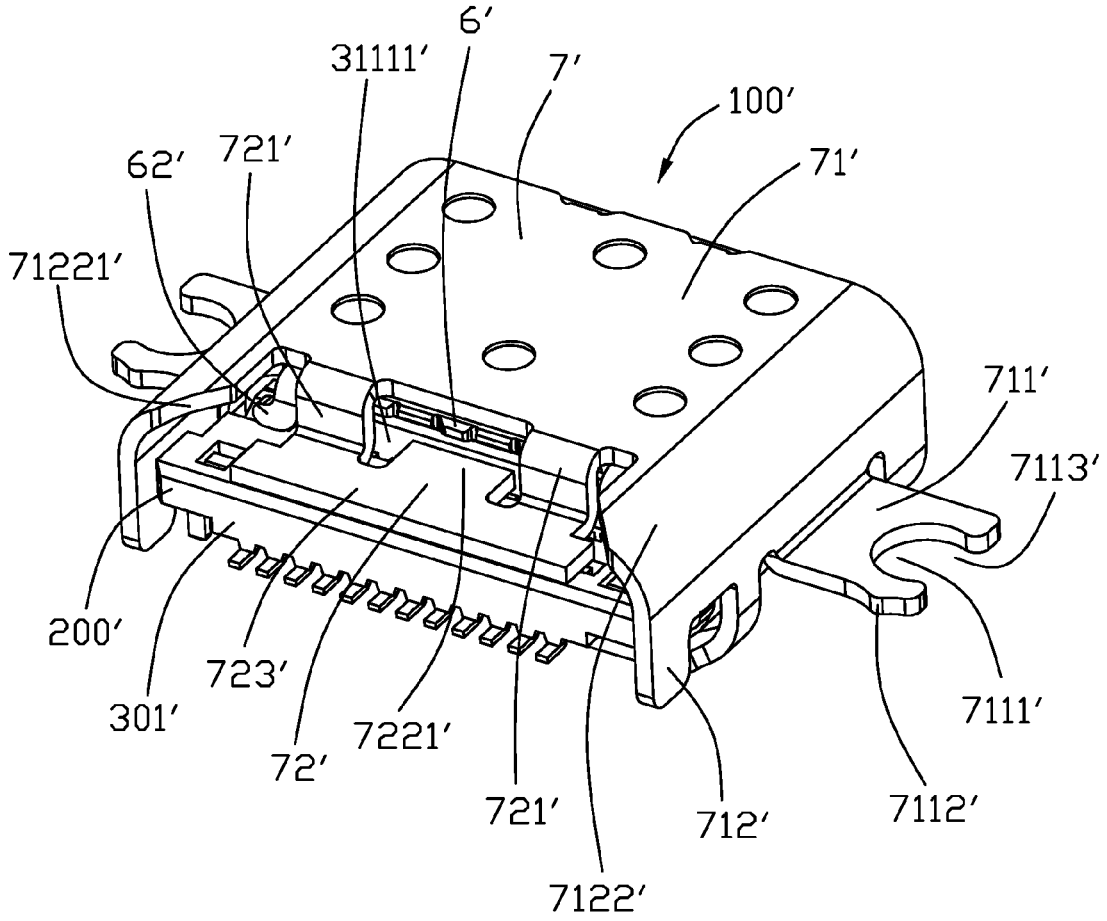
FIG. 15 is a perspective view of the contact module of the electrical connector according to a second embodiment.
Figure 16:
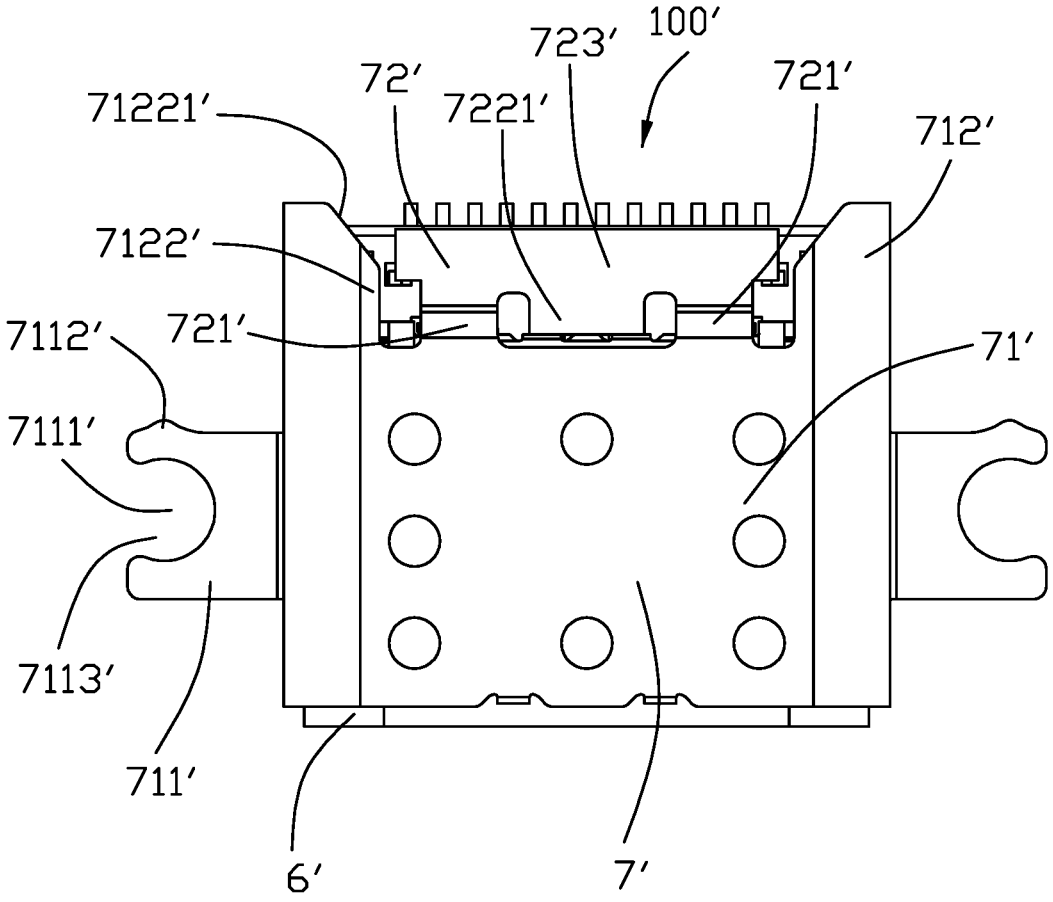
FIG. 16 is a top view of the electrical connector of FIG. 15.

Referring to FIGS. 15-16, in the second embodiment which is different from the first embodiment with the outer shell 7'. The shell 7' includes a main body 71', a rear cover 72' extending from the main body 71'. The rear cover 72' includes a pair of connection sections 721' extending downwardly from the main body 71', and a step section 723' extending rearwardly from the pair of connection sections 721'. A abutment section 7221' extends forwardly from the step section 723'. The pair of connection sections 721' are located between the rear abutment sections 62'. The step section 723' covers the base 301' and the abutment sections 7221' abuts against the base 301' forwardly.

Compared with the first embodiment, the shell 7' includes the front mounting legs 711' defining a cutout 7113', and the rear mounting leg 712' defining a protrusion 7112'. The extension section 7122' is curved and defines a tapered surface 71221'.

Figure 17:
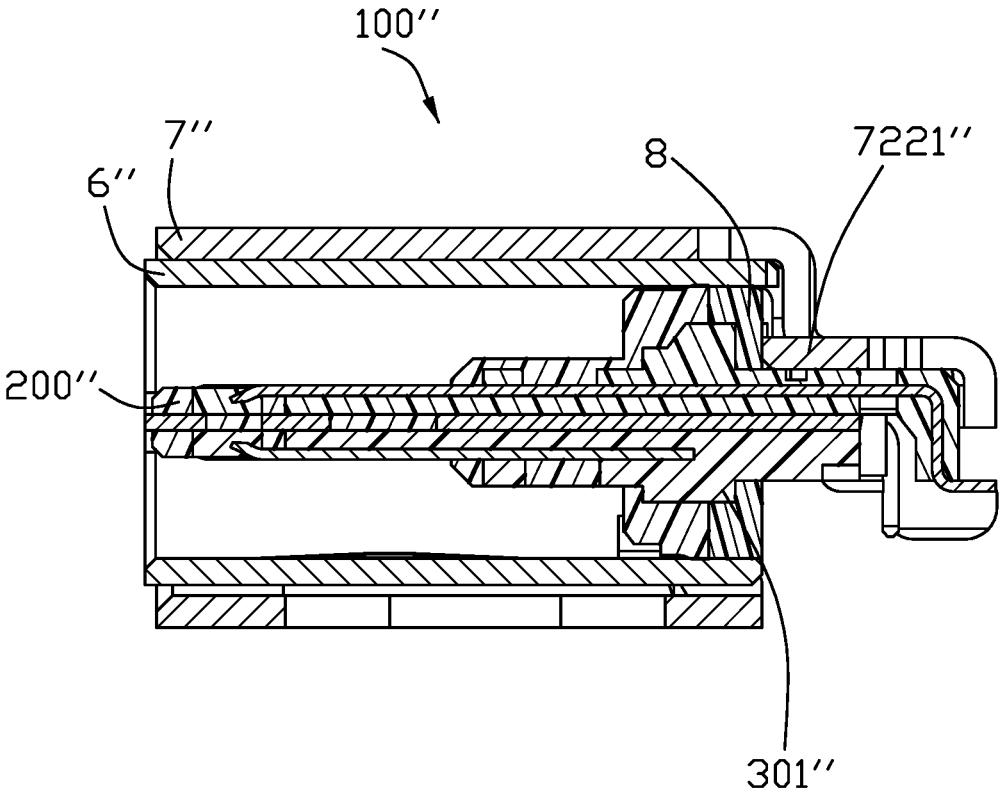
FIG. 17 is a cross-sectional view of the electrical connector according to a third embodiment.

Referring to FIG. 17, the third embodiment further includes a glue plate 8 located behind the base 301" in the shell 6" so as to have the abutment sections 7221" abut against the glue plate 8.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a metallic inner shell;

a metallic outer shell attached upon the inner shell;

a contact module received within the inner shell and including a plurality of contacts integrally formed within an insulative housing via insert-molding;

the inner shell forming a front abutment section to rearwardly abut against the insulative housing;

the outer shell forming an abutment section to forwardly abut against the insulative housing; wherein the outer shell includes a main body and a rear cover extending rearwardly and downwardly from the main body, and the rear cover covering a rear side of the insulative housing and includes a horizontal step section from which said abutment section forwardly extends.

2. The electrical connector as claimed in claim 1, wherein said outer shell further includes a securing leg under the step section in a vertical direction so as to have the insulative housing sandwiched therebetween in the vertical direction.

3. The electrical connector as claimed in claim 2, wherein the housing forms a securing groove to receive the securing leg therein.

4. The electrical connector as claimed in claim 1, wherein the inner shell further includes a rear abutment section forwardly abutting against the insulative housing.

5. The electrical connector as claimed in claim 4, wherein the rear abutment section of the inner shell is located above the abutment section of the outer shell.

6. The electrical connector as claimed in claim 1, wherein said rear cover further includes a connection section downwardly extending from the main body, and the step section extends rearwardly from the connection section.

7. The electrical connector as claimed in claim 6, wherein said connection section is located around a center region of the electrical connector in a transverse direction.

8. The electrical connector as claimed in claim 6, wherein said abutment section is located around a center region of the electrical connector in a transverse direction.

9. The electrical connector as claimed in claim 1, wherein the main body of the outer shell includes a front mounting leg and a rear mounting leg.

10. The electrical connector as claimed in claim 9, wherein the rear mounting leg further includes a securing leg cooperating with the step section to sandwich the housing therebetween in a vertical direction.

11. The electrical connector as claimed in claim 9, wherein the step section of the rear cover further includes a side abutment to sidewardly abut against the rear mounting leg for reinforcement.

12. An electrical connector comprising: a metallic inner shell;

a metallic outer shell attached upon the inner shell;

a contact module received within the inner shell and including a plurality of contacts integrally formed within an insulative housing via insert-molding;

a glue plate attached upon a rearward face of the contact module;

the inner shell forming a front abutment section to rearwardly abut against the insulative housing;

the outer shell forming an abutment section to forwardly abut against the glue plate; wherein the outer shell includes a main body and a rear cover extending rearwardly and downwardly from the main body, and the rear cover covering a rear side of the insulative housing and includes a horizontal step section from which said abutment section forwardly extends.

13. The electrical connector as claimed in claim 12, wherein said outer shell further includes a securing leg under the step section in a vertical direction so as to have the insulative housing sandwiched therebetween in the vertical direction.

14. The electrical connector as claimed in claim 12, wherein the inner shell further includes a rear abutment section forwardly abutting against the insulative housing.

15. The electrical connector as claimed in claim 14, wherein the rear abutment section of the inner shell is located above the abutment section of the outer shell.

* * * * *